US007886559B2

(12) United States Patent
Hell et al.

(10) Patent No.: US 7,886,559 B2
(45) **Date of Patent: *Feb. 15, 2011**

(54) MODULAR REFRIGERATOR

(75) Inventors: Erich Hell, Giengen (DE); Michael Neumann, Munich (DE); Jan-Grigor Schubert, Senden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 446 days.

This patent is subject to a terminal disclaimer.

(21) Appl. No.: 11/666,538

(22) PCT Filed: Oct. 10, 2005

(86) PCT No.: PCT/EP2005/055128

§ 371 (c)(1),
(2), (4) Date: Apr. 27, 2007

(87) PCT Pub. No.: WO2006/045694

PCT Pub. Date: May 4, 2006

(65) Prior Publication Data

US 2009/0064700 A1 Mar. 12, 2009

(30) Foreign Application Priority Data

Oct. 29, 2004 (DE) ..... 10 2004 052 622

(51) Int. Cl.

| | |
|---|---|
| ***F25D 19/00*** | (2006.01) |
| ***G01K 13/00*** | (2006.01) |
| ***F25D 11/02*** | (2006.01) |
| ***F25D 11/00*** | (2006.01) |
| ***F25D 23/00*** | (2006.01) |
| ***A47F 3/04*** | (2006.01) |
| ***A47B 96/00*** | (2006.01) |
| ***A47B 47/00*** | (2006.01) |

(52) U.S. Cl. ..... 62/298; 62/129; 62/441; 62/264; 62/440; 62/443; 312/116; 312/400; 312/401; 312/405; 312/406.2; 312/263

(58) Field of Classification Search ..... 62/129, 62/441, 264, 440, 443; 312/116, 400, 401, 312/405, 406.2, 263
See application file for complete search history.

(56) References Cited

U.S. PATENT DOCUMENTS 3,349,220 A * 10/1967 Kinney ..... 219/218

(Continued)

FOREIGN PATENT DOCUMENTS

DE 84 15 798 U 9/1985

(Continued)

OTHER PUBLICATIONS

International Search Report PCT/EP2005/055128.

(Continued)

*Primary Examiner*—Thomas E Denion
*Assistant Examiner*—Michael Carton
(74) *Attorney, Agent, or Firm*—James E. Howard; Andre Pallapies

(57) ABSTRACT

A modular refrigerator, having a first planar thermally-insulated element, a second planar thermally-insulated element and further planar thermally-insulated elements, connected together and which can be subsequently detached, forming a housing of the refrigerator when assembled, a refrigerant circuit, with an evaporator, a condenser and a compressor, a first electrical line, arranged in the first planar element, a second electrical line, arranged in the second planar thermally-insulated element and an electrical contact/counter-contact device, by means of which both electrical lines may be electrically connected. The contact device is integrated in the first planar thermally-insulated element and the counter-contact device is integrated in the second planar thermally-insulated element such that contact device is automatically electrically connected to the electrical counter-contact during the mechanical connection of the first and second planar element.

16 Claims, 9 Drawing Sheets

U.S. PATENT DOCUMENTS

Figure 1:
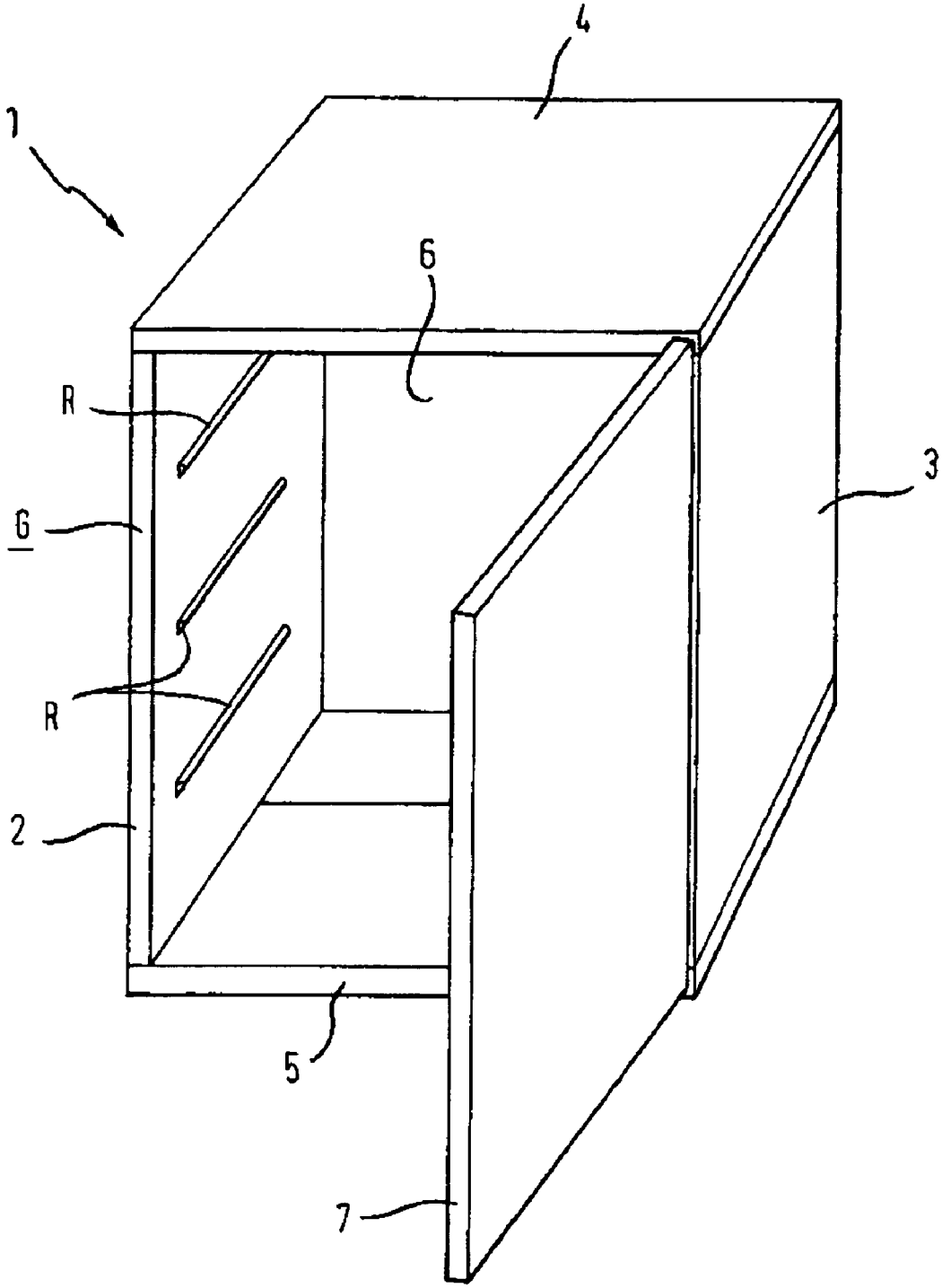

| | | | | |
|---|---|---|---|---|
| 5,921,095 | A * | 7/1999 | Lee et al. | 62/175 |
| 6,071,015 | A * | 6/2000 | Erbse et al. | 385/88 |
| 2006/0144058 | A1 | 7/2006 | Kentner et al. | |

FOREIGN PATENT DOCUMENTS

| | | | |
|---|---|---|---|
| JP | 7-294097 | | 11/1995 |
| JP | 2002-228345 | | 8/2002 |
| WO | WO2004062444 | A2 * | 7/2004 |

OTHER PUBLICATIONS

National Search Report 10 2004 052 622.2.

* cited by examiner

MODULAR REFRIGERATOR

The invention relates to a modular refrigerator such as that described in DE 84 14 798 U1.

The modular refrigerator disclosed in DE 84 15 798 U1 consists of two replaceable lateral walls, a rear wall, a ceiling wall, a bottom wall and a front door which are fastened to one another by means of fastening and articulating means. The lateral walls, the rear wall, the ceiling wall and the bottom wall are each manufactured as a complete unit and form the housing of the refrigerator. A compressor, a condenser, a thermostat and a throttle valve of the refrigerator are all arranged on the rear wall. Electrical lines, whose ends are provided with a plug or plug coupling, extend through the walls. When the housing is assembled the electrical lines are connected together by means of the plugs and pug couplings in such a manner that a closed circuit is formed. The individual walls are then connected together and tightened one against the other with screws, for example. Projections of the electrical lines, the plugs and plug couplings are in this case received in suitable recesses in the walls in a concealed manner. The disadvantage of this design is that the joining of the individual walls and the contacting of the electrical lines are carried out separately.

The object of this invention is therefore to provide a modular refrigerator designed in such a manner that its assembly is simplified.

The object of the invention is achieved by a modular refrigerator comprising a first planar thermally insulated element, a second planar thermally insulated element and further planar thermally insulated elements which can be connected together and which can subsequently be detached from each other, and when connected, form a housing of the refrigerator, a refrigerant circuit which comprises an evaporator, a condenser and a compressor, a first electrical line arranged in the first planar element, a second electrical line arranged in the second planar thermally insulated element, and an electrical contact/counter-contact device by means of which both electric lines may be electrically connected, characterised in that the contact device is integrated in the first planar thermally insulated element and the counter-contact device is integrated in the second planar thermally insulate element in such a manner that the contact device automatically contacts the counter-contact device electrically during the mechanical connection of the first and second planar elements. The modular refrigerator according to the invention is provided, in particular, for being supplied in the unassembled condition, i.e. disassembled, to an end consumer, for example, so that this or these planar thermally insulated elements, which comprise two lateral elements, one bottom element, a ceiling element and a rear wall, for example, can be assembled together to form a functional refrigerator. However, planar thermally insulated elements may also be a combination of a lateral element and a ceiling element, for example, i.e. a planar thermally insulated element is part of the housing of the refrigerator. The individual planar thermally insulated elements may each comprise an inner lining and an outer lining which surround a cavity filled with a thermal insulation material. In addition to a mechanical connection of the planar thermally insulated elements it is also necessary to make electrical connections, e.g. an electrical line from the refrigeration control system to the refrigerant circuit. Because the contact device automatically contacts the counter-contact device during the mechanical connection of the two planar thermally insulated elements, i.e. the contact device automatically contacts the counter-contact device during the mechanical assembly of the housing, the required electrical connections are established during the mechanical assembly of the housing. Separate manual joining of the electrical contact/counter-contact device is therefore unnecessary, thereby simplifying the assembly of the housing.

According to variants of the refrigerator according to the invention the contact/counter-contact device is an electrical plug-socket device and/or the first or second planar thermally insulated element is the rear wall of the housing, the refrigerant circuit being arranged on the rear wall.

If the rear wall is to be designed particularly compactly, it may comprise a recess arranged in the lower region of the rear wall, in which recess the compressor is fastened. The size of the recess is preferably adapted to the spatial extensions of the compressor and preferably does not therefore extend throughout the width of the rear wall. To enable the compressor to discharge exhaust heat into the atmosphere surrounding the assembled refrigerator, the recess may be accessible from outside the housing.

If the electricity supply for the electronic components of the refrigerator derives from the rear wall, as is provided for according to a further variant of the refrigerator according to the invention, the cost of the electricity supply for the entire refrigerator can be minimised and the refrigerator can therefore be designed as compactly as possible.

To ensure that the refrigerator according to the invention has as few electrical connection points as possible, both the electricity supply for the electronic components and the electrical control signal from the electronic components to the refrigerant circuit can be supplied via the electrical contact/counter-contact device according to one embodiment.

If, according to a further variant of the refrigerator according to the invention, all the electronic components are combined to form a single electronic unit, the number of electrical lines is reduced. The electronic components comprise, for example, a temperature sensor, the temperature regulating electronics, a setting device for setting the theoretical temperature or a luminous device for illuminating the interior of the housing.

According to a variant of the refrigerator according to the invention the electronic unit is fastened to one inner side of the first or second planar thermally insulated element.

For example, in order to reduce the cost of laying the electrical lines, channel is integrated inside the housing for feeding through at least one of the two electrical lines according to a further variant of the refrigerator according to the invention. This channel may, for example, be in the form of an empty tube or may also be provided for establishing a refrigerant circuit connection. The channel is advantageously laid in the planar thermally-insulated element to which the electronic unit is also fastened. It is particularly advantage for one of the channel to lead to the electronic unit and the other end of the channel to the counter-contact device, so that both the electricity supply for the electronic unit and the electrical line for the electrical control signals transmitted by the electronic unit for the refrigerant circuit to be able to be conducted in the same channel. This provides a relatively clearly arranged and simple electrical line routing. It is also advantageous for the channel to run in the rear wall and for one of the channel to terminate at the electrical contact device so that the electricity supply for the electronic unit and the electrical line for the electrical control signals transmitted by the electronic unit for the refrigerant circuit again to be conducted in this channel.

An exemplary embodiment of a modular refrigerator according to the invention is shown by way of example in the diagrammatic figures below.

Figure 2:
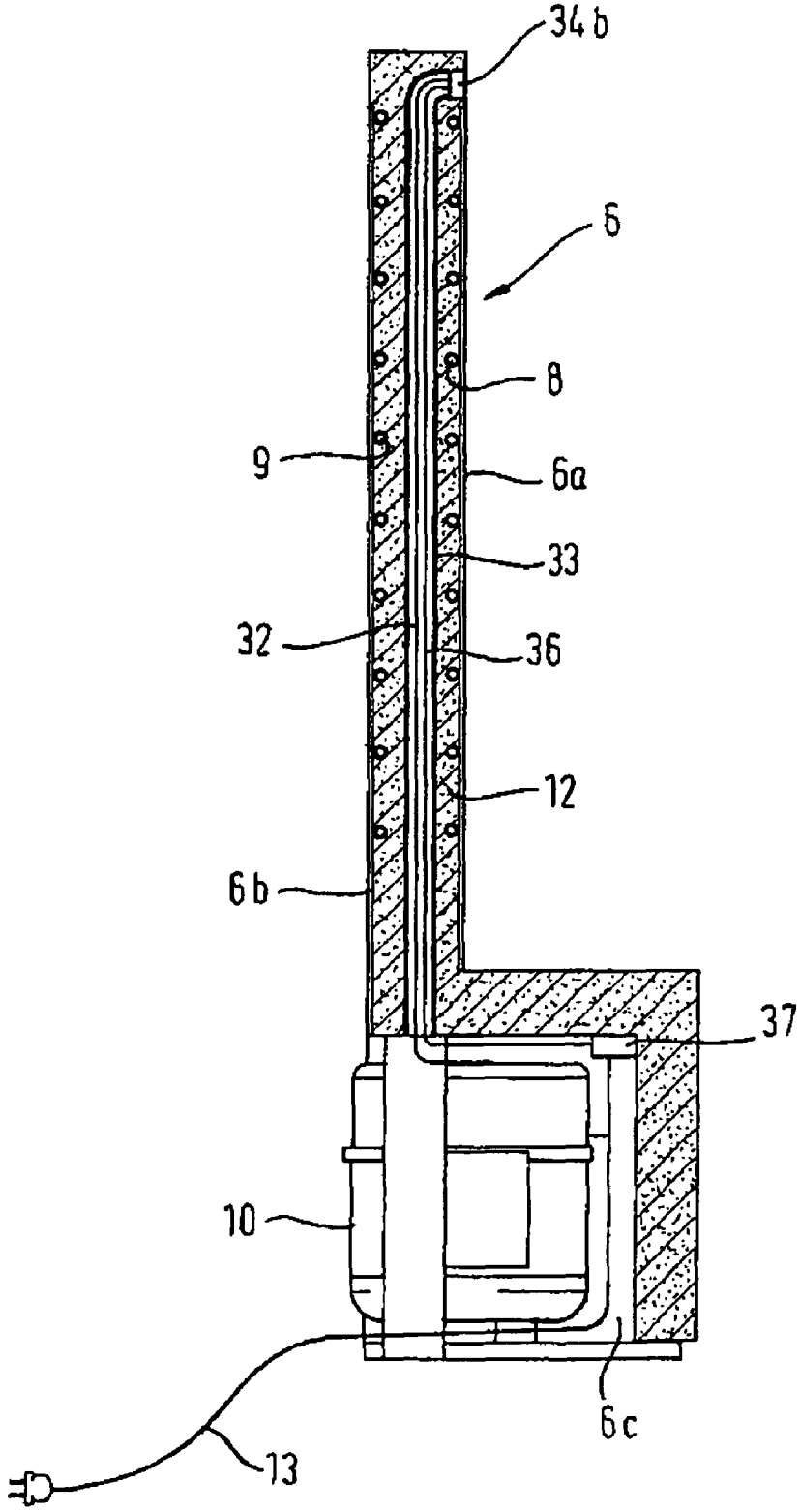
Figure 3:
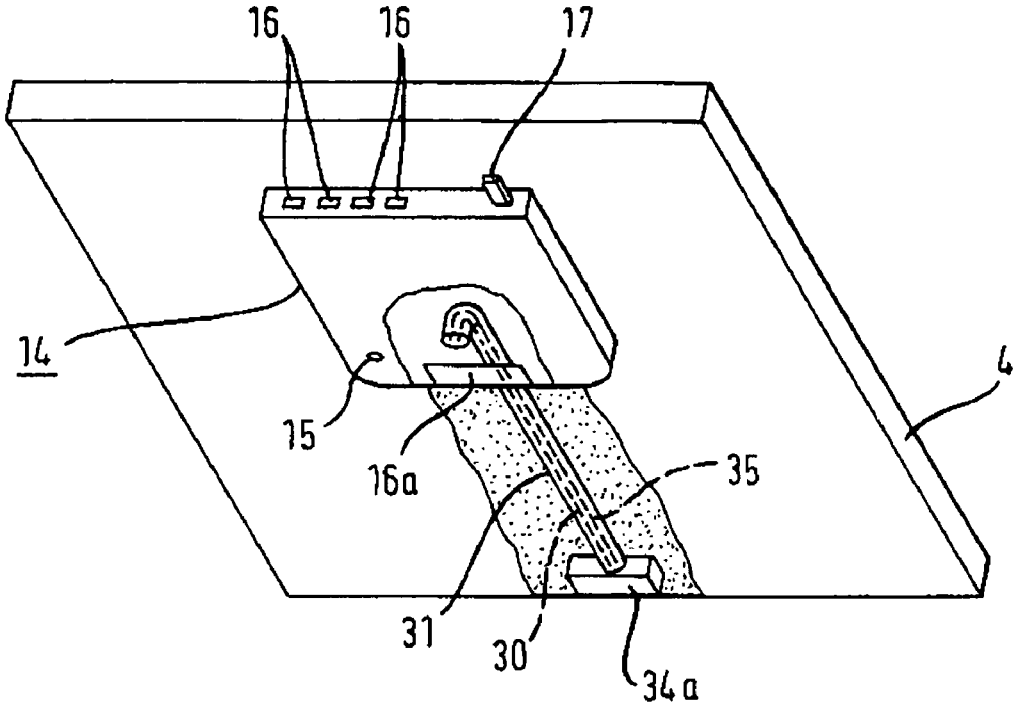
Figure 4:
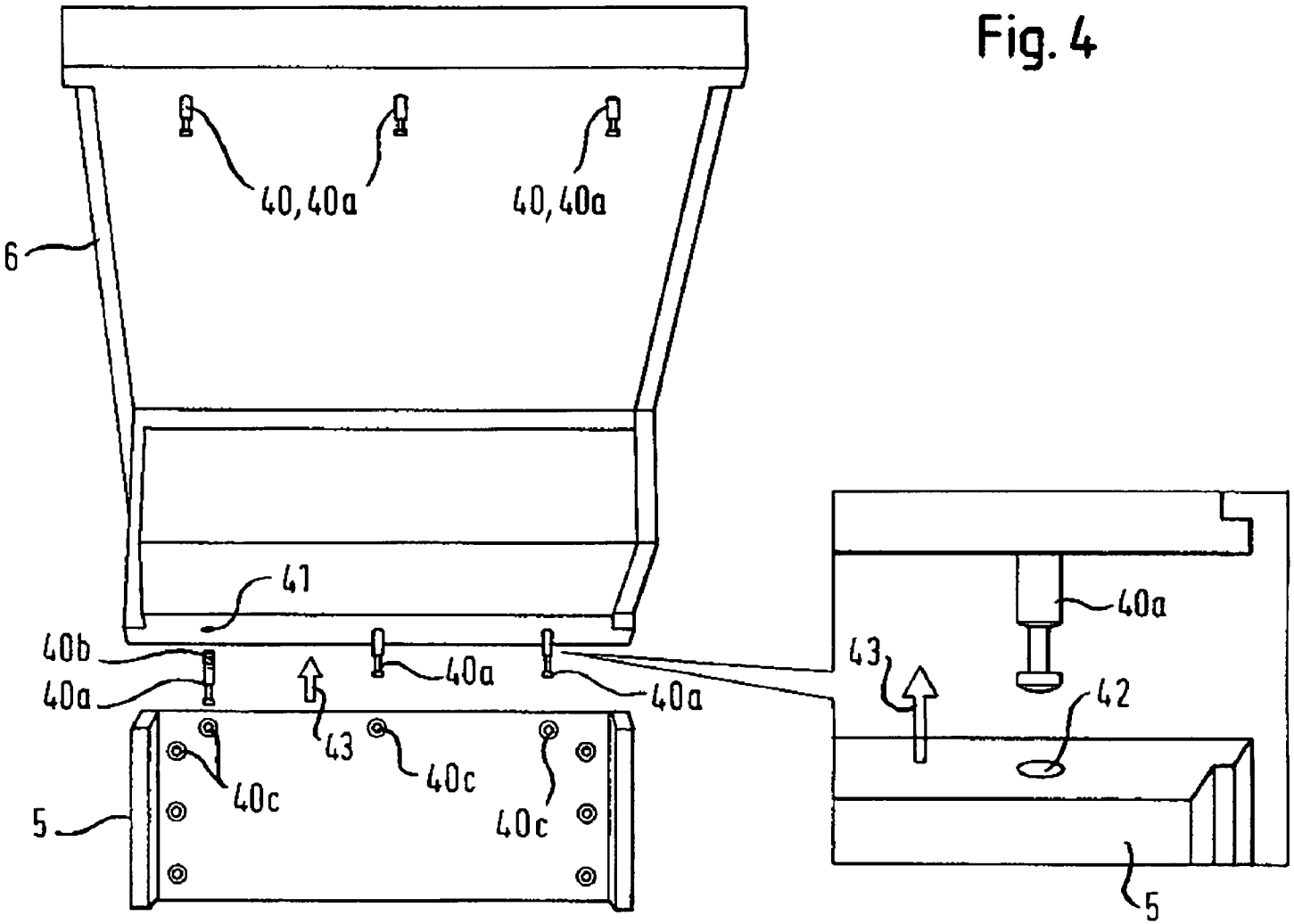
Figure 5:
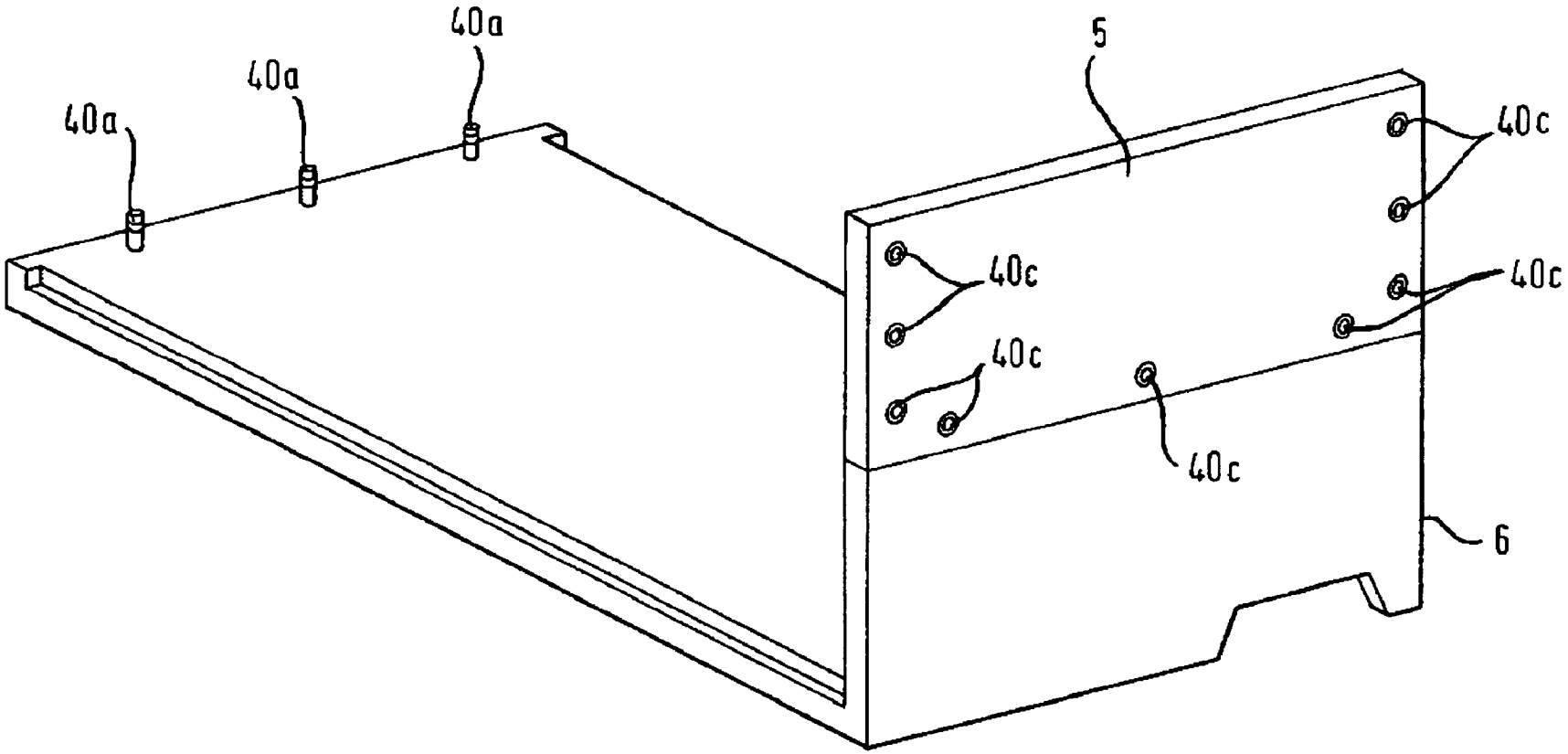
Figure 6:
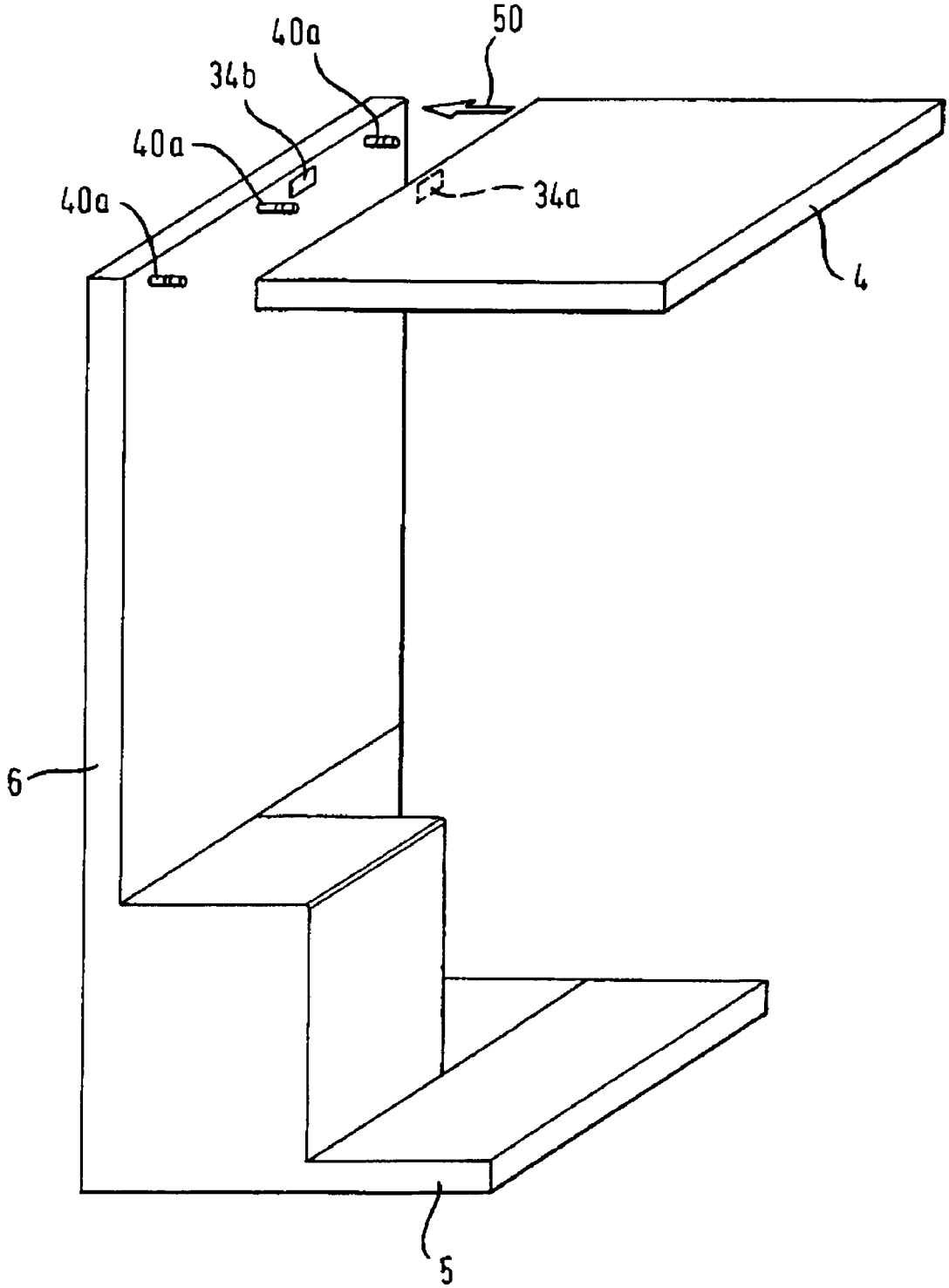
Figure 7:
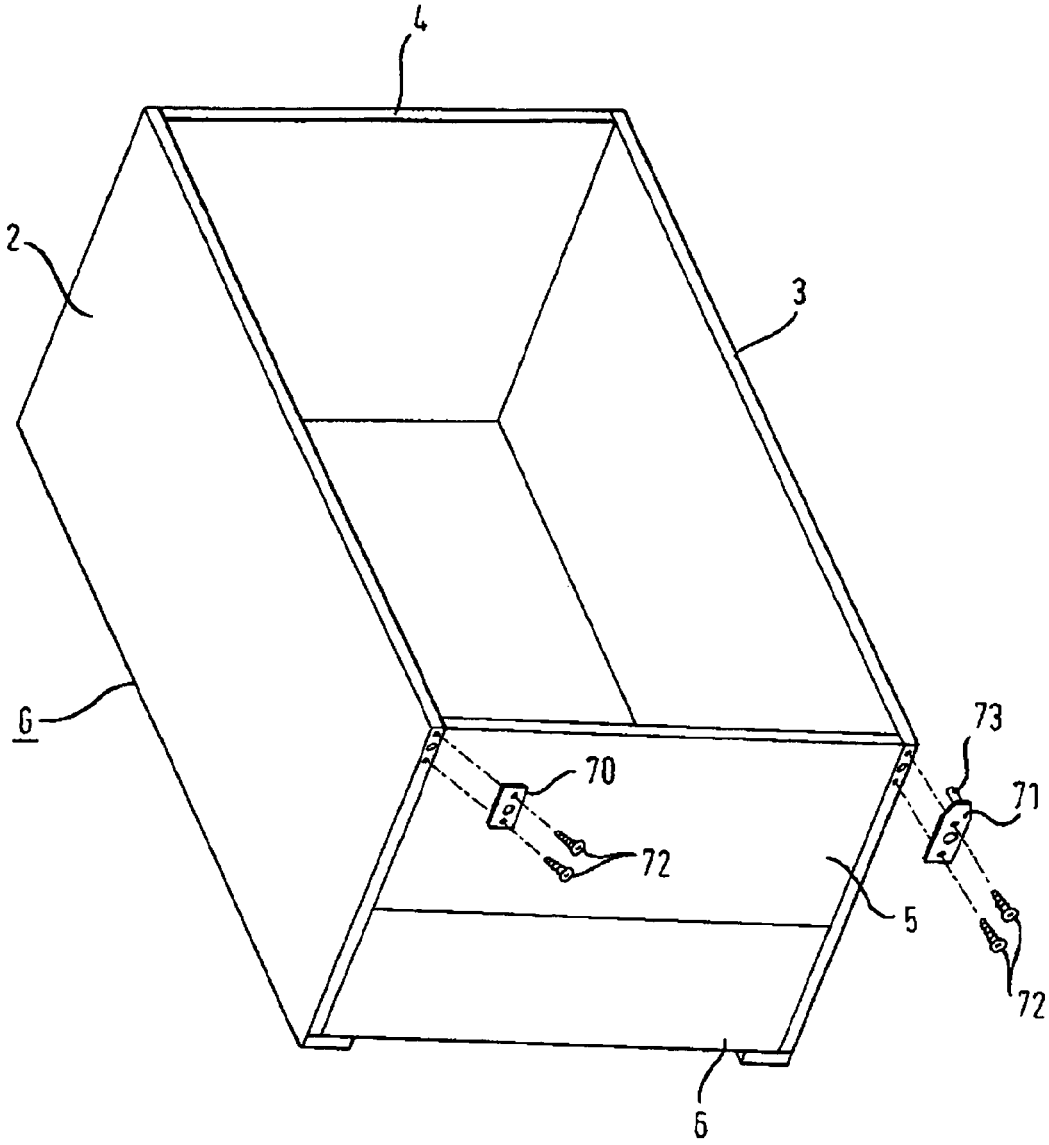
Figure 8:
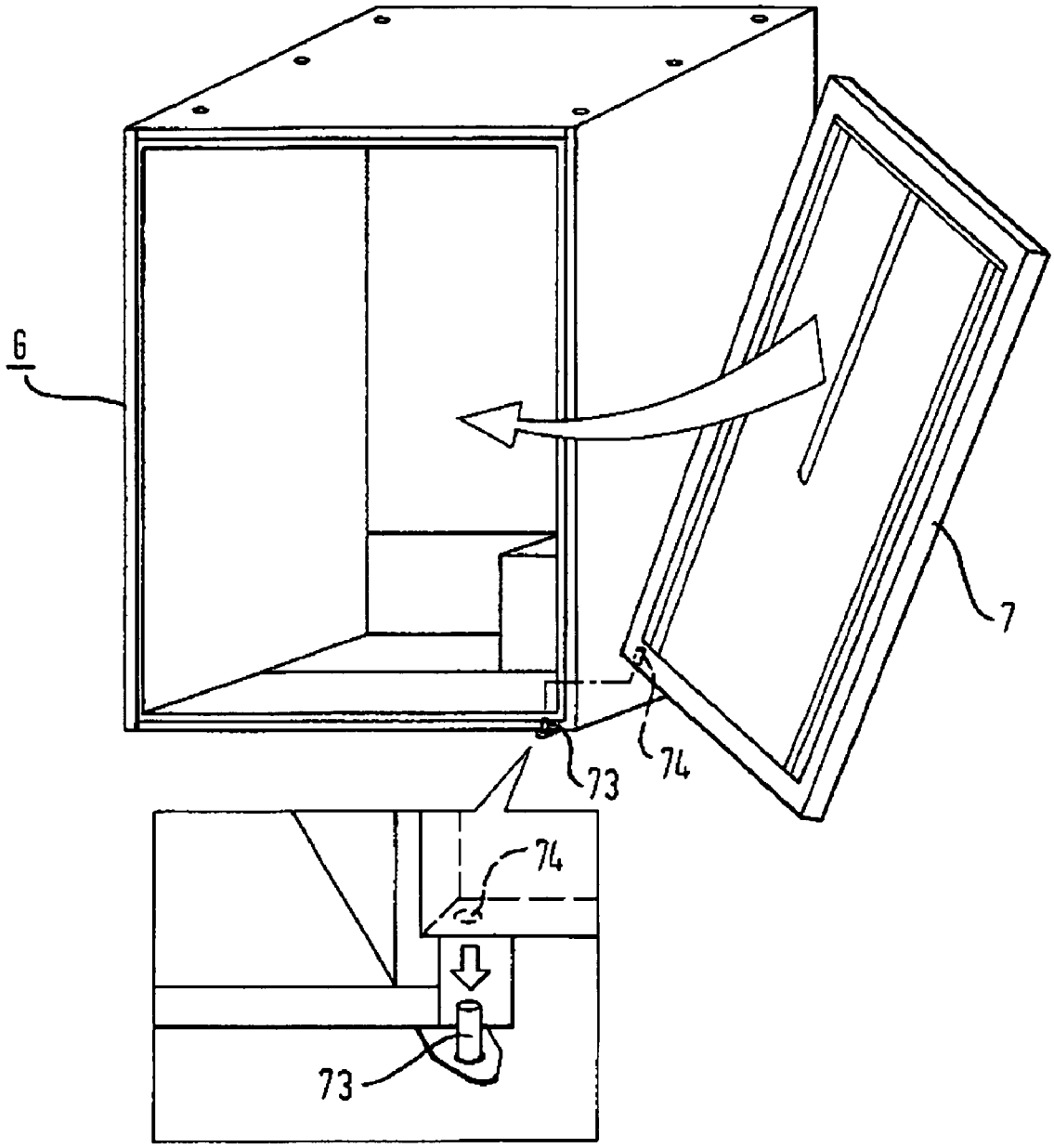
Figure 9:
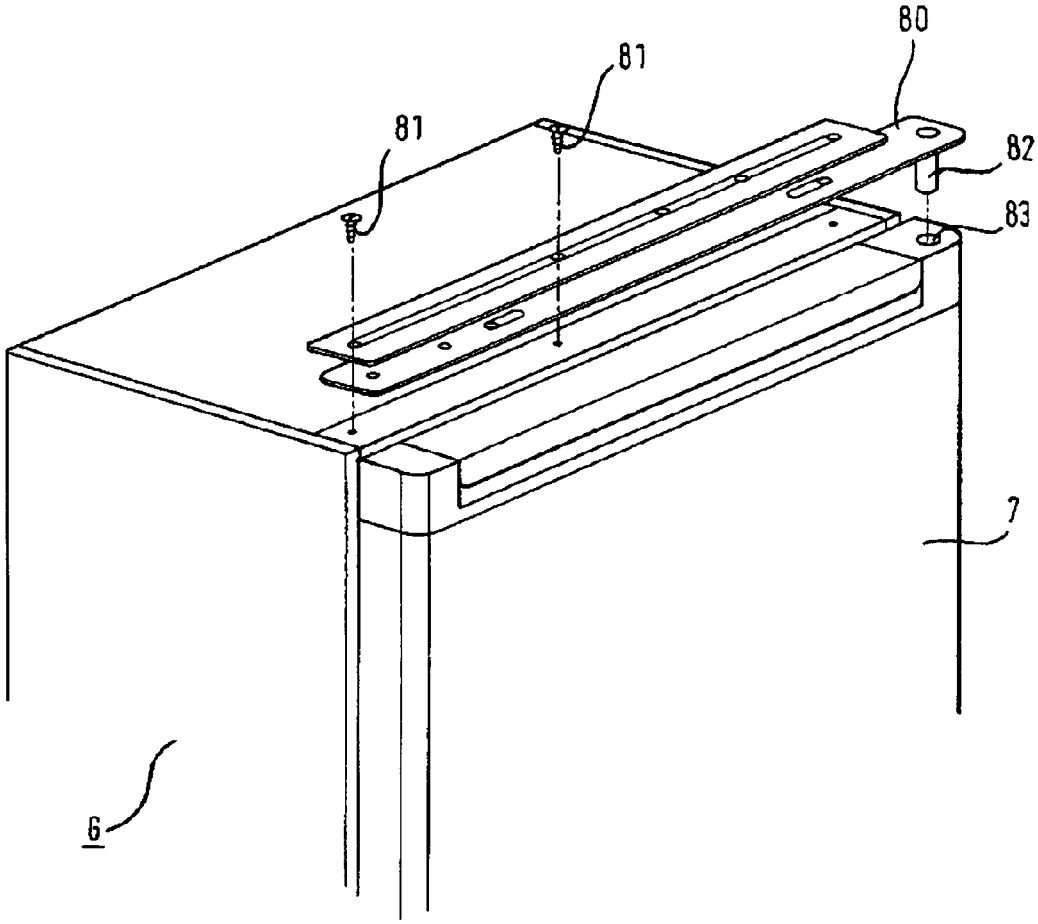

FIG. 1 shows the modular refrigerator when assembled,

FIG. 2 shows the rear wall with the refrigerant circuit of the refrigerator shown in FIG. 1, FIG. 3 shows the ceiling element with an electronic unit of the refrigerator shown in FIG. 1, FIG. 4 shows the rear wall and the bottom element detached from each other, FIG. 5 shows the rear wall and the bottom element connected to each other, FIG. 6 shows the rear wall with a bottom element connected to it and a ceiling element detached from it, FIG. 7 shows the ready assembled housing of the refrigerator, FIG. 8 shows the housing and a door of the refrigerator unassembled, and FIG. 9 shows the housing of the refrigerator with the door partially assembled.

FIG. 1 shows a modular refrigerator 1 assembled and ready for operation. Refrigerator 1 comprises in this exemplary embodiment two lateral walls 2 and 3, a ceiling element 4, a bottom element 5, a rear wall 6 and a door 7, which have been assembled to form refrigerator 1. Both lateral walls 3 and 3, ceiling element 4, bottom element 5 and rear wall 6 form in this exemplary embodiment housing G of refrigerator 1, which can be sealed with door 7. An inner device of refrigerator 1, e.g. drawers or shelves, is not shown in detail in the figures. However, a ribbed area R for receiving shelves is shown. In the case of this exemplary embodiment ribbed area R was produced during a drawing or injection process of the inner lining of lateral walls 2 and 3 enclosing a thermal insulation material. Both lateral walls 2 and 3, ceiling element 4, bottom element 5, rear wall 6 and door 7 are connected together so that they can also be detached from each other.

Both lateral walls 2 and 3, ceiling element 4, bottom element 5, rear wall 6 and door 7 are designed as planar thermally insulated elements and in the case of this exemplary embodiment each comprise an inner and an outer lining which surround a cavity filled with a thermal insulation material. In the case of this exemplary embodiment the thermal insulation material is an insulating foam 12. FIG. 2 shows in more detail, by way of example, rear wall 6 with its inner lining 6*a* and its outer lining 6*b*.

Furthermore, the entire refrigerant circuit of refrigerator 1 is fastened to rear wall 6. The refrigerant circuit comprises essentially an evaporator 8, a condenser 9, lines connecting evaporator 8, condenser 9 and compressor 10, not shown in detail in the figures, and a refrigerant not shown in greater detail. Both evaporator 8 and condenser 9, which are tube-on-plate heat transmitters in this exemplary embodiment, are connected by foam to the insulating foam 12 of rear wall 6. In this case evaporator 8 is in heat conducting contact with inner lining 6*a* and condenser 9 is in heat conducting contact with outer lining 6*b*. This enables condenser 9 to discharge its heat relatively effectively to the air surrounding refrigerator 1 and evaporator 8 to cool relatively effectively the interior of housing G of refrigerator 1. It also makes it possible to arrange as much insulating foam 12 as possible to be arranged between evaporator 8 and condenser 9, which means that condenser 9 heats evaporator 8 as little as possible.

In this exemplary embodiment rear wall 6 comprises a recess 6*c* arranged in the lower region of rear wall 6, in which recess is fastened a compressor 10. Recess 6*c* is constructed so that it is accessible from outside housing G of refrigerator 1 so that compressor 10 is able to discharge its heat relatively effectively to the air surrounding housing G. In this exemplary embodiment recess 6*c* does not extend throughout the width of housing G. Compressor 10 is also supplied with electricity via a mains cable 13.

In this exemplary embodiment the refrigerant circuit is tested before delivery of the disassembled refrigerator 1 and is fully functional, i.e. refrigerator 1 is ready for operation as soon as it is assembled and connected to an electricity mains.

In this exemplary embodiment refrigerator 1 comprises another electronic unit 14 in which all the electronic components of refrigerator 1 are assembled. Electronic unit 14 is shown in greater detail in FIG. 3. In this exemplary embodiment the electronic components comprise a regulating and control unit, not shown in detail, for regulating the inside temperature of refrigerator 1, a temperature sensor 15 required for this regulation, inputting means 16 for setting the desired theoretical temperature of refrigerator 1 and illumination 16*a* for illuminating the interior of housing G. In this exemplary embodiment electronic unit 14 is fastened to the inner surface of ceiling element 4 and comprises a switch 17, which interacts with door 7 so that illumination 16*a* is switched on when door 7 is open and is switched off when door 7 is closed.

In order to regulate the temperature of refrigerating appliance 1, electronic unit 14 is electrically connected to compressor 10 when refrigerator 1 is assembled. In this exemplary embodiment this electrical connection comprises an electrical line 30 which runs in a channel running in ceiling element 4 of refrigerator 1, which channel is in this exemplary embodiment an empty tube 31, an electrical line 32 which runs in a channel running in rear wall 6, which channel is in this exemplary embodiment an empty tube 33, and an electrical contact and counter-contact device, which in this exemplary embodiment is an electrical plug-socket device. Socket 34*a* of the plug-socket device is here fastened to ceiling element 4 and plug 34*b* of the plug-socket device is fastened to rear wall 6.

In this exemplary embodiment empty tube 33 is lathered in insulating foam 12 of rear wall 6 and empty tube 31 is lathered in the insulating foam of ceiling element 4. The one end of empty tube 31 integrated in ceiling element 4 leads to electronic unit 14, and the other end of empty tube 31 leads to socket 34*a*. The one end of empty tube 33 integrated in rear wall 6 leads to recess 6*c* and the other end of empty tube 33 leads to plug 34*b*. Electrical line 30 running in empty tube 31 electrically connects electronic unit 14 to socket 34*a*, electrical line 32 running in empty tube 33 connects compressor 10 electrically to plug 34*b*, and plug 34*b* and socket 34*a* are designed so that when assembled, electronic unit 14 is electrically connected to compressor 10 so that electronic unit 14 activates compressor 10 according to the set theoretical temperature and the actual temperature measured with temperature sensor 15.

An electricity supply provided for electronic unit 14, in the form of electrical lines 35 and 36, which are also laid in empty tubes 31 and 33 and are connected to one another by means of the plug-socket device. Power supply 37 required for establishing the low voltage is secured in recess 6*c* of rear wall 6 in this exemplary embodiment.

The assembly of refrigerator 1 is now explained in more detail in the following with reference to FIGS. 4 to 9. To obtain housing G of refrigerating appliance 1, bottom element 5 and rear wall 6 are first connected to furniture fittings 40 in this exemplary embodiment. Furniture fittings 40 are designed so that bottom element 5 and rear wall 6 can also be detached from each, i.e. so that housing G can also be taken apart again. Some of furniture fittings 40 are shown in more detail in FIG. 4. FIG. 4, together with FIG. 5, also illustrate, by way of example, how rear wall 6 and bottom element 5 are connected to one another by means of some of furniture fittings 40.

In this exemplary embodiment furniture fittings 40 each comprise a metal pin 40*a*, which is provided with a thread 40*b*. In this exemplary embodiment thread 40*b* is screwed into holes 41 predrilled into rear wall 6 with a screwdriver, not shown. One of metal pins 40*a*' is shown in FIG. 4 still in the unscrewed condition. The remaining metal pins 40*a* shown in FIG. 4 are, on the other hand, shown already screwed into rear wall 6.

After metal pins 40*a* have been screwed into rear wall 6, bottom element 5, which in this exemplary embodiment comprises predrilled holes 42 corresponding to metal pins 40*a*, are fitted to rear wall 6 in the direction of arrows 43 so that metal pins 40*a* screwed in rear wall 6 are inserted into holes 42 of bottom element 5 corresponding to them. Metal pins 40*a* are then provided with lock nuts 40*c*, by means of the screwdriver, so that rear wall 6 and bottom element 5 are fixedly connected to one another, as shown in FIG. 5.

After bottom element 5 and rear wall 6 have been fixedly connected to one another by means of furniture fittings 40, further metal pins 40*a* are screwed into rear wall 6 in holes predrilled for this purpose. These screwed metal pins 40*a* are shown in FIG. 6 in the screwed condition. Ceiling element 4 is then presented to rear wall 6 in the direction of arrow 50 so that metal pins 40*a* are inserted into holes of ceiling element 4 corresponding to them, not shown in FIG. 6. By inserting metal pins 40*a* of rear wall 60 into the holes in ceiling element 4, socket 34*a* fastened to ceiling element 4 and plug 34*b* fastened to rear wall 6 are also aligned relative to one another so that they are automatically connected when ceiling element 4 and rear wall 6 are joined together, thus enabling the electrical contact to be made between compressor 10 and electronic unit 14. Finally metal pins 40*a* are also provided with lock nuts 40*c* so that rear wall 6 and ceiling element 4 are fixedly connected to one another.

Finally, in order to assembly housing G fully both lateral walls 2 and 3 are also connected to furniture fittings 40, rear wall 6, ceiling element 4 and bottom element 5. The fully assembled housing G is shown in FIG. 7.

Moreover, two further fittings 70 and 71 are each screwed with two screws 72 to the lower side of housing G. One of fittings 71 is provided with a pin 73 to which door 7 of refrigerator 1 can be pivotably fastened. As illustrated in FIG. 8, door 7 is first placed on pin 73 of fitting 71 for fastening door 7 to housing G. Door 7 has a suitable hole 74 for this purpose.

A further fitting 80 is then screwed on with screws 81 to the upper side of housing G, as can be seen in FIG. 9. Fitting 80 comprises a pin 82, which is inserted into a further hole 83 of door 7.

In this exemplary embodiment evaporator 8 and condenser 9 are essentially identical tube-on-plate heat transmitters. In particular, different tube-on-plate heat transmitters may also be used for evaporator 8 and condenser 9. Other types of heat transmitters are also conceivable for evaporator 8 and condenser 9. In particular, a roll-bond evaporator is suitable.

The invention claimed is:

1. A modular refrigerator having a first planar thermally insulated element, a second planar thermally insulated element and further planar thermally insulated elements which can be connected to each other and can be detached from each other again and, when connected, form a housing of the refrigerator having an internal volume, a refrigerant circuit which comprises an evaporator, a condenser and a compressor, a first electrical line arranged in the first planar element, a second electrical line arranged in the second planar thermally insulated element and an electrical contact/counter-contact device, to which the two electrical lines can be electrically connected, wherein the contact device is integrated in the first planar thermally insulated element and the counter-contact device is integrated in the second planar thermally insulated element so that the contact device automatically contacts the electrical counter-contact device electrically during the mechanical connection of the first and the second planar elements, a rear wall of the refrigerator and a top wall of the refrigerator are different ones of the planar thermally insulated elements, and the first planar thermally insulated element and the second planar thermally insulated element at least partially define the internal volume.

2. The modular refrigerator according to claim 1, wherein the electrical contact/counter-contact device includes an electrical plug-socket device.

3. The modular refrigerator according to claim 1, wherein the first or the second planar thermally insulated element is a rear wall of the housing and the refrigerant circuit is arranged on the rear wall.

4. The modular refrigerator according to claim 3, further comprising electronic components of the refrigerator that produce electrical control signals, wherein an electricity supply for the electronic components of the refrigerator derives from the rear wall.

5. The modular refrigerator according to claim 4, wherein both the electricity supply for electronic components of the refrigerator and the electrical control signals from the electronic components of the refrigerator are conducted to the refrigerant circuit via the electrical contact/counter-contact device.

6. The modular refrigerator according to claim 5, wherein all the electronic components are assembled together to form one electronic unit.

7. The modular refrigerator according to claim 6, wherein the electronic unit is fastened to one inside of the first or second planar thermally insulated element.

8. The modular refrigerator according to claim 1, wherein a channel is integrated in the first and/or second planar thermally insulated element for feeding through at least one of the two electrical lines and a refrigerant circuit connection.

9. A modular refrigerator, comprising:

a refrigerant circuit, the refrigerant circuit including an evaporator, a condenser and a compressor;

a first planar thermally insulated element;

a first electrical wire embedded in the first planar element;

a first connector embedded in the first planar element and electrically connected to the first electrical wire;

a second planar thermally insulated element;

a second electrical wire embedded in the second planar element;

a second connector embedded in the second planar element and electrically connected to the second electrical wire; and further planar thermally insulated elements, wherein, the first planar element, the first connector, the second planar element and the second connector are adapted to automatically make an electrical connection between the first connector and the second connector when the first planar element is mechanically connected to the second planar element, the planar elements, when connected, form a housing of the refrigerator, the housing having an internal volume, the electrical connection and the mechanical connection between the first planar element and the second planar element are capable of being detached and reattached, a rear wall of the refrigerator and a top wall of the refrigerator are different ones of the planar elements, and the first planar element and the second planar element at least partially define the internal volume.

10. The modular refrigerator according to claim 9, wherein the first connector is a plug and the second connector is a socket for receiving the plug.

11. The modular refrigerator according to claim 9, wherein the first or the second planar element is a rear wall of the modular refrigerator and the refrigerant circuit is arranged on the rear wall.

12. The modular refrigerator according to claim 11, further comprising electronic components of the refrigerator that produce electrical control signals, wherein an electricity supply for the electronic components of the refrigerator derives from the rear wall.

13. The modular refrigerator according to claim 12, wherein both the electricity supply for electronic components of the refrigerator and the electrical control signals from the electronic components of the refrigerator are conducted to the refrigerant circuit via the first and second connectors.

14. The modular refrigerator according to claim 13, wherein all the electronic components of the refrigerator are assembled together to form one electronic unit.

15. The modular refrigerator according to claim 14, wherein the electronic unit is fastened to an inside of the first planar element or an inside of the second planar element.

16. The modular refrigerator according to claim 9, wherein a channel is integrated in the first and/or second planar element for feeding through at least one of the two electrical wires and a refrigerant circuit connection.

* * * * *